United States Patent [19]

Satake et al.

[11] Patent Number: 4,729,983

[45] Date of Patent: Mar. 8, 1988

[54] HEAT-SENSITIVE RECORDING MATERIAL

[75] Inventors: Toshimi Satake; Tomoaki Nagai; Fumio Fujimura, all of Tokyo, Japan

[73] Assignee: Jujo Paper Co., Ltd., Tokyo, Japan

[21] Appl. No.: 872,233

[22] Filed: Jun. 9, 1986

[30] Foreign Application Priority Data

Jul. 10, 1985 [JP] Japan ..... 60-150090

[51] Int. Cl.[4] ..... B41M 5/18

[52] U.S. Cl. ..... 503/211; 427/150; 503/216; 503/217; 503/225

[58] Field of Search ..... 346/210, 211, 216, 225; 427/150–152; 503/210, 211, 216, 217, 225

[56] References Cited

U.S. PATENT DOCUMENTS 4,232,083 11/1980 Buerkley et al. ..... 346/211
4,531,141 7/1985 Sagawa ..... 346/211

FOREIGN PATENT DOCUMENTS 0089193 5/1984 Japan ..... 346/211
0093386 5/1984 Japan ..... 346/211

*Primary Examiner*—Bruce H. Hess
*Attorney, Agent, or Firm*—Koda and Androlia

[57] ABSTRACT

A heat-sensitive recording material comprises a support and a color-developing layer having both a particular saturated higher fatty acid iron salt and a particular polyvalent phenolic derivative. The heat-sensitive recording material provides a superior thermal response and a high stabilty of the developed image.

7 Claims, No Drawings

HEAT-SENSITIVE RECORDING MATERIAL

BACKGROUND OF THE INVENTION

1. Field of the Invention

This invention relates to a heat-sensitive recording material which is suitable for a high speed recording and has a high stability of developed image against oily substances and solvents such as alcohols.

2. Prior Art

A heat-sensitive recording sheet that utilizes a heat color-forming reaction occurring between a colorless or pale-colored chromogenic dyestuff and a phenolic material, or an organic acid is disclosed, for example, in the Japanese Patent Publication Nos. 4160/1968 and 14039/1970 and in the Japanese Laid-Open Patent Application No. 27736/1973, and is now widely applied for practical use.

In general, a heat-sensitive recording sheet is produced by applying on a support, such as paper, film etc., the coating which is prepared by individually grinding and dispersing a colorless chromogenic dyestuff and a color-developing material into fine particles, mixing the resultant dispersion with each other and then adding thereto binder, filler, sensitizer, slipping agent and other auxiliaries. The coating, when heated, undergoes instantaneously a chemical reaction which forms a color. In this case, various bright colors may be formed depending upon the selection of colorless chromogenic dyestuff.

These heat-sensitive recording sheets have now been finding a wide range of applications, including medical or industrial measurement recording instruments, terminal printers of computer and information communication systems, facsimile equipments, printers of electronic calculators, automatic ticket vending machines, and so on.

In recent years, as the heat-sensitive recording systems are widely used and the applications of such recording are diversified, high image density is now required for the improvement of the resolution. The heat energy of the thermal head in the recording equipments capable of such high density is more minimized. Therefore, it is required that the heat-sensitive recording sheet has a higher color-forming sensitivity sufficient for producing clear chromogenic record with such small heat energy.

Meanwhile, the heat-sensitive recording sheets are inevitably touched with the hand of man, in view of their function as recording sheets of the information.

As the fingers of the operator are often adhered by solvents such as alcohols etc., or by oily substances such as his hair tonic daily used and oils contained in the sweat on his skin, it may be said that the heat-sensitive recording sheets are most frequently contaminated by such substances. In general, the heat-sensitive recording sheets have insufficient stability against these oily substances and the solvents such as alcohols, acetone etc., so that the density of the developed color image on the contaminated part is often reduced or disappeared. The contaminated white ground causes the phenomenon of discoloration or color forming. Their reasons can not be sufficiently elucidated yet, but it is supposed that such substances partly dissolve the coloring layer consisting of the fine granular basic colorless dyestuff and organic developer or coloring reactant thereof, or make the coloring layer or coloring reactant thereof unstable.

Also, the developed images disappear, or the coloring reaction through the solvent between dyestuff and color-developing agent, i.e. the color development of the ground color, occurs.

In order to increase these stabilities, there was proposed a method in which a barrier layer is formed on the color-developing layer comprising both a leuco dyestuff and an organic color-developing agent to prevent the contact with such solvents or oily substances. However, this method has disadvantages that a barrier layer with good oil-resistance and solventresistance is not obtained and the lowering of the sensitivity occurs.

Besides the heat-sensitive color-developing system in which the above colorless dyestuff is used, a color-developing system under the use of metal compounds is known.

For examples, the Japanese Patent Publication No. 8781/1957 describes the combined use of iron stearate (electron acceptor) with tannic acid or gallic acid, and the Japanese Patent Publication No. 6485/1959 describes the combined use of an electron acceptor such as silver stearate, iron stearate, gold stearate, copper stearate or mercury stearate with an electron donator such as methyl gallate, ethyl gallate, propyl gallate, butyl gallate or dodecyl gallate. Since these heat-sensitive recording sheets are based on a heat-sensitive copying system by means of the heat energy of light, they bring the troubles of accumulated residues and sticking under applying to heat-sensitive recording system which uses the thermal printing heads. In this case, they have as disadvantages a low image density, greenish color, poor brightness of the background, inferior stability against solvents such as alcohols, and the flowing-out of the color-developing layer.

SUMMARY OF THE INVENTION

It is the object of this invention to provide a heat-sensitive recording material which has a superior thermal response and a high stability of developed image against oily substances and solvents such as alcohols.

This invention lies in the improvement of the heat-sensitive color-developing system which used metal compounds, among two above-described heat-sensitive color-developing systems. The above problems are solved as follows.

The heat-sensitive color-developing layer is produced by coating on a support the heat-sensitive color-developing system comprising both a saturated higher fatty acid iron salt with 16–35 carbon atoms and a polyvalent phenolic derivative represented by the following general formula (I):

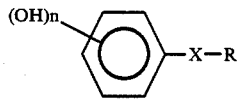

(I)

wherein R represents an alkyl group having 18–35 carbon atoms, n represents an integer from 2 to 3, and —X— represents $—CH_2—$, —O—, —CONH—, $$—\underset{\underset{R'}{|}}{CON}—$$

(R′ is an alkyl group having 5–10 carbon atoms), $—SO_2—$, $—SO_3—$, or $—SO_2NH—$.

DETAILED DESCRIPTION OF THE INVENTION

The polyvalent phenolic derivatives used as electron donator in this invention are described as follows, but they are not limited to the following compounds:

(1)

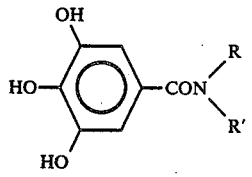

(R is an alkyl group having $C_{18}$–$C_{35}$)
(R' is an alkyl group having $C_5$–$C_{30}$).

(2)

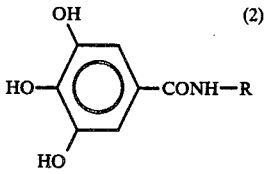

(3)

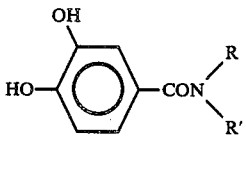

(4)

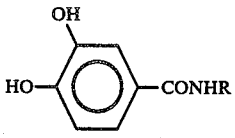

(5)

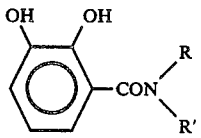

(6)

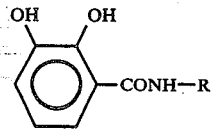

(7)

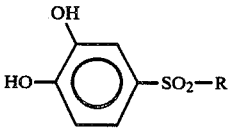

(8)

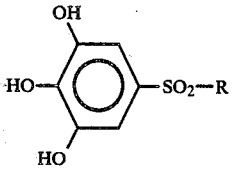

(9)

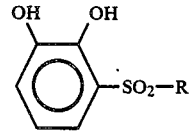

(10)

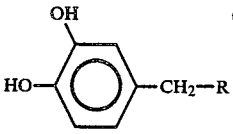

(11)

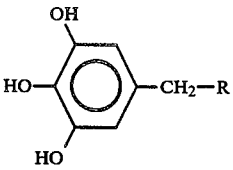

(12)

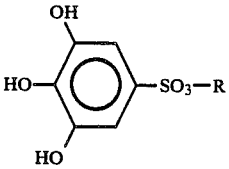

(13)

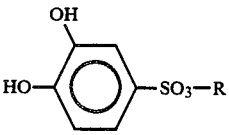

(14)

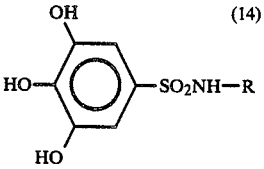

(15)

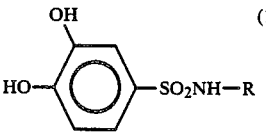

In preparing the coating by dispersing the above polyvalent phenolic derivative in water-system or solvent-system binder, it is required that these phenolic derivatives do not react with the electronacceptor, and that the solvent-resistance and the dispersing stability of the phenolic derivatives are improved. In this invention, therefore, the substituent group other than the color forming group has a large carbon number of 18 to 35. Further, it is preferable that the number of hydroxyl groups is 2 to 3 and the hydroxyl groups are adjacent to one another.

These polyvalent phenols are used independently. It is possible to use two or more polyvalent phenols, if necessary.

Examples of the representative saturated higher fatty acid iron used in the invention include the following (1) to (4). However, the saturated higher fatty acid iron used is not limited to the examples.

(1) iron stearate,
(2) iron behenate,
(3) iron montanate, and
(4) acid wax iron salt.

These saturated higher fatty acid irons may be used independently as an electron acceptor for heat sensitive recording paper. It is possible to use two or more saturated higher fatty acid irons simultaneously. Further, leuco dyes may be used together with them. In this case, however, a decrease in solvent resistance is observed.

In this invention, the specific polyvalent phenol is used as electron doner. It is possible to use phenols or organic acids together with the specific polyvalent phenol, the phenols or organic acids being employed in a heat sensitive recording system in which colorless dyes are used according to the use and performance of heat sensitive recording material. Examples of such phenols or organic acids include bisphenol A, p,p'-(1-methylnormalhexyliden) diphenol, p-tertiary-butylphenol, p-phenylphenol, p-hydroxybenzoate, novolak type phenol resin, 4-hydroxy-1-methyl sulfonyl benzene and 4-hydroxy-1-butyl oxysulfonyl benzene. However, the single use of the electron doner according to this invention is obviously superior to in resistance to the solvent such as alcohol or the like. Further, in this invention, anti-foggants (e.g. fatty acid amide, ethylene bisamide, montan wax), sensitizers (e.g. dibenzyl terephthalate, benzyl p-benzyloxybenzoate, di-p-trylcarbonate, p-benzylbiphenyl) and stabilizers (e.g. metal salts of phthalic acid monoester, metal salts of p-tertiary-butylbenzoate, metal salts of nitrobenzoic acid) may be contained in the heat sensitive coloring layer, whereby peculiar effects can be expected for the agents, respectively.

The colorless leuco dyestuffs may be used in this invention and are, for example, as follows.

Triphenylmethane leuco dyes 3,3-bis(p-dimethylaminophenyl)-6-dimethylaminophthalide (crystall violet lactone)

Fluoran leuco dyes 3-diethylamino-6-methyl-7-anilinofluoran
3-(N-ethyl-p-toluidino)-6-methyl-7-anilinofluoran
3-(N-ethyl-N-isoamyl)amino-6-methyl-7-anilinofluoran
3-diethylamino-6-methyl-7-(o,p-dimethylanilino)fluoran
3-pyrolidino-6-methyl-7-anilinofluoran
3-pyperidino-6-methyl-7-anilinofluoran
3-(N-cyclohexyl-N-methylamino)-6-methyl-7-anilinofluoran
3-pyperidino-6-methyl-7-anilinofluoran 3-(N-cyclohexyl-N-methylamino)-6-methyl-7-anilinofluoran
3-diethylamino-7-(m-trifluoromethylanilino)fluoran
3-dibutylamino-7-(o-chloroanilino)fluoran
3-diethylamino-6-methyl-chlorofluoran
3-diethylamino-6-methyl-fluoran
3-cyclohexylamino-6-chlorofluoran
3-diethylamino-7-(o-chloroanilino)fluoran
3-diethylamino-benzo[a]-fluoran Azaphthalide leuco dyes 3-(4-diethylamino-2-ethoxyphenyl)-3-(1-ethyl-2-methylindole-3-yl)-4-azaphthalide
3-(4-diethylamino-2-ethoxyphenyl)-3-(1-ethyl-2-methylindole-3-yl)-7-azaphthalide
3-(4-diethylamino-2-ethoxyphenyl)-3-(1-octyl-2-methylindole-3-yl)-4-azaphthalide
3-(4-N-cyclohexyl-N-methylamino-2-methoxyphenyl)-3-(1-ethyl-2-methylindole-3-yl)-4-azaphthalide Florene leuco dyes 3,6,6'-tris(dimethylamino)spiro[fluorene-9,3'-phthalide]
3,6,6'-tris(diethylamino)spiro[fluorene-9,3'-phthalide]

These dyestuffs may be used alone or in combination.

As the binders of this invention, there can be mentioned, for example, a fully saponified polyvinyl alcohol having a polymerization degree of 200–1900, a partially saponified polyvinyl alcohol, carboxylated polyvinyl alcohol, amide-modified polyvinyl alcohol, sulfonic acid-modified polyvinyl alcohol, butyralmodified polyvinyl alcohol, other modified polyvinyl alcohol, hydroxyethyl cellulose, methyl cellulose, carboxymethyl cellulose, styrene/malic acid anhydride copolymers, styrene/butadiene copolymers, cellulose delivatives such as ethyl cellulose, acetyl cellulose, etc.; polyvinyl chloride, polyvinyl acetate, polyacryl amide, polyacrylic acid ester, polyvinyl butyrol, polystyrol and copolymers thereof; polyamide resin, silicone resin, petroleum resin, terpene resin, ketone resin and cumaron resin.

These polymeric materials may be used after they were dissolved in a solvent such as water, alcohol, ketone, ester hydrocarbon, etc., or after they were emusified or dispersed in water or a solvent other than water.

The species and the amountof saturated higher fatty acid iron salt, polvalent phenol derivative, binder, and other ingredients are determined depending upon the performance and recording apptitude required for the heat-sensitive recording material, and are not otherwise limited. However, in ordinary cases, it is suitable to use 1–6 parts by weight of polyvalent phenolic derivative and 2–15 parts by weight of filler, based on 1–6 parts by weight of saturated-higher fatty acid iron salt, and to add 0.5–4 parts by weight of a binder in total solid content.

The aimed heat-sensitive recording material may be obtained by coating the above coating color on a support such as paper, synthetic paper, film, etc.

The above saturated-higher fatty acid iron salt, the above polyvalent phenol derivative, if necessary organic color-developing agent and basic colorless dyestuff are ground down to a particle size of several microns or smaller by means of a grinder or emulsifier such as a ball mill, attritor, sand grinder, etc. and binder and various additives in accordance with the purpose, are added thereto to prepare coating colors. The additives of this invention are, for example, inorganic or organic fillers such as silica, calcium carbonate, kaolin, calcined kaolin, diatomaceous earth, talc, titanium dioxide, aluminium hydroxide; releasing agent such as metal salts of fatty acids, etc.; slipping agent such as waxes, etc.; UV-absorbers such as benzophenone type or triazole type; waterresistance agent such as glyoxal, etc.; dispersant; anti-foamer; etc.

(Function)

The heat sensitive recording material of the present invention is stable in ground color to the solvent such as alcohol. The reason for this is considered as follows. Namely, both of the organic acid iron and polyvalent phenol used in the invention contain in the molecule thereof an alkyl group having a carbon number of 16 or 18 to 35. Therefore, they are extremely low in dissolution and diffusion rate and saturation solubility to the solvent. Consequently, even in the case of pollution with the solvent, the physicochemical reaction of the organic acid iron with the polyvalent phenol does not take place and, therefore, the stability in ground color is never deteriorated.

On the other hand, the heat sensitive recording substance is thought to be excellent in oil resistancedue to the irreversible thermal melting coloring reaction of the organic acid iron with the polyvalent phenol. Namely, the thermal melting coloring reaction takes place to form a stable complex. It is though that the complex is so stable that the bonding is never cut even with the adhesion of hairdressings or fats and oils and, therefore, colored images are stable.

This invention will be described by way of examples hereunder. Throughout the specification the parts are units by weight.

EXAMPLES 1–8

Solution A (dispersion of electron acceptor)

| | |
|---|---|
| iron behenate | 4.0 parts |
| 10% aqueous solution of polyvinyl alcohol | 10.0 parts |
| water | 6.0 parts |

Solution B (dispersion of electron donor)

| | |
|---|---|
| polyvalent phenol derivative (See Table 1) | 4.0 parts |
| zinc stearate | 1.5 parts |
| 10% aqueous solution of polyvinyl alcohol | 13.75 parts |
| Water | 8.25 parts |

The solution A and B of the above-mentioned composition were individually ground to a particle size of 3 microns by attritor. Then, the dispersions were mixed in the following portion to prepare the coating color.

Coating Color

| | |
|---|---|
| Solution A | 20.0 parts |
| Solution B | 36.5 parts |
| Kaolin clay (50% aqueous dispersion) | 12.0 parts |

The coating color was applied on the one side of a base paper weighing 50 g/m$^2$ at a coating weight of 6.0 g/m$^2$ and was then dried. The resultant paper was treated to a smoothness of 200–600 seconds by a supercalender. In this manner a heat-sensitive recording paper was obtained.

COMPARATIVE EXAMPLE 1

Solution A (dispersion of electron acceptor)

| | |
|---|---|
| iron stearate | 4.0 parts |
| 10% aqueous solution of polyvinyl alcohol | 10.0 parts |
| water | 6.0 parts |

Solution B (dispersion of electron donor)

| | |
|---|---|
| propyl gallate | 4.0 parts |
| zinc stearate | 1.5 parts |
| 10% aqueous solution of polyvinyl alcohol | 13.75 parts |
| water | 8.25 parts |

The solutions A and B of the above-mentioned composition were individually ground to a particle size of 3 microns by attritor. Then, the dispersions were mixed in the same portion as in Example 1 to prepare the coating color.

The coating color was applied on one side of a base paper weighing 50 g/m$^2$ at a coating weight of 6.0 g/m$^2$ and was dried. The resultant paper was treated to a smoothness of 200–600 seconds by a supercalender. In this manner, a heat-sensitive recording paper was obtained.

COMPARATIVE EXAMPLE 2

A heat-sensitive recording paper was prepared in the same procedure as in Comparative Example 1, except that lauryl gallate is used in stead of proxyl gallate in solution B of comparative Example 1.

COMPARATIVE EXAMPLES 3–5

Solution A (dispersion of dyestuff)

| | |
|---|---|
| 3-diethylamino-6-methyl-7-anilinofluoran | 2.0 parts |
| 10% aqueous solution of polyvinyl alcohol | 4.6 parts |
| water | 2.5 parts |

Solution B (dispersion of color-developing agent)

| | |
|---|---|
| color-developing agent (see Table 1) | 6.0 parts |
| zinc stearate | 0.5 parts |
| 10% aqueous solution of polyvinyl alcohol | 30.0 parts |

The solutions A and B of the above-mentioned composition were individually ground to a particle size of 3 microns by attritor. Then, the dispersions were mixed in the following portion to prepare the coating color.

Coating Color

| | |
|---|---|
| Solution A (dispersion of dyestuff) | 9.1 parts |
| Solution B (dispersion of color-developing agent) | 36.5 parts |
| Kaolin clay (50% aqueous dispersion) | 12.0 parts |

The coating color was applied on one side of a base paper weighing 50 g/m$^2$ at a coating weight of 60 g/m$^2$ and was dried. The resultant paper was treated to a smoothness of 200–600 seconds by a supercalender. In this manner, a heat-sensitive recording paper was obtained.

The heat-sensitive recording papers obtained in Examples and Comparative Examples were tested for the below-described articles. The test results were shown in Table 1.

Note (1) Optical density: The optical density of the image printed under the condition of a copy mode, using the apparatus KB 4800 (manufactured by TOSHIBA CORPORATION) was measured by a Macbeth densitometer (using RD-514 and amber filter, same in the following).

(2) Oil resistance (after oil treatment): Castor oil droplets were dropped on the developed portion printed by the method of Note 1, was wiped off after 10 seconds. After leaving for 3 days, the optical density was measured by a Macbeth densitometer.

(3) Residual density: Residual density is calculated by the following equation $$\text{Residual density} = \frac{\text{optical density after oil treatment}}{\text{optical density before oil treatment}} \times 100\ (\%)$$

(4) Humidity-resistance: The optical density of the background after leaving for 24 hours under the circumstance of high humidity (90% RH) at 40° C.

(5) Solvent resistance: 95% ethyl alcohol solution was dropped on not colored portion. After 30 minutes, the optical density was measured by a Macbeth densitometer.

(6) Solvent resistance (%): The colored portion printed by the method of Note (1) was impregnated in 95% ethyl alcohol solution for 30 minutes. then, the residual density was determined.

TABLE 1

| | | Results of performance test | | | | | | | |
|---|---|---|---|---|---|---|---|---|---|
| | | | Oil resistance | | | Background | | | |
| | Electron donor (Color developing agent) | Optical density (1) | Before oil treatment | After oil treatment (2) | Residual density (%) (3) | Before oil treatment | Humidity-resistance (4) | Solvent-resistance (5) | Solvent-resistance (%) (6) |
| Examples | | | | | | | | | |
| 1 | 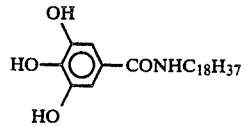 | 0.98 | 0.98 | 0.98 | 100 | 0.05 | 0.08 | 0.09 | 98 |

TABLE 1-continued
| | Electron donor (Color developing agent) | Optical density (1) | Results of performance test: Oil resistance: Before oil treatment | After oil treatment (2) | Residual density (%) (3) | Background: Before oil treatment | Humidity-resistance (4) | Solvent-resistance (5) | Solvent-resistance (%) (6) |
|---|---|---|---|---|---|---|---|---|---|
| 2 | 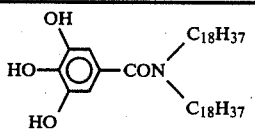 | 0.91 | 0.91 | 0.90 | 99 | 0.06 | 0.09 | 0.09 | 95 |
| 3 | 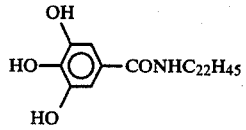 | 0.84 | 0.84 | 0.84 | 100 | 0.05 | 0.08 | 0.11 | 96 |
| 4 | 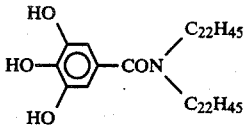 | 0.82 | 0.82 | 0.81 | 99 | 0.05 | 0.08 | 0.10 | 93 |
| 5 | 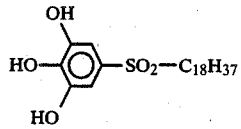 | 0.84 | 0.84 | 0.83 | 99 | 0.06 | 0.09 | 0.11 | 90 |
| 6 | 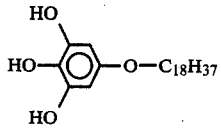 | 0.80 | 0.80 | 0.79 | 99 | 0.06 | 0.09 | 0.11 | 91 |
| 7 | 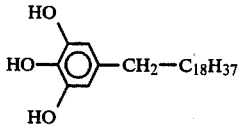 | 0.82 | 0.82 | 0.80 | 98 | 0.07 | 0.09 | 0.12 | 90 |
| 8 | 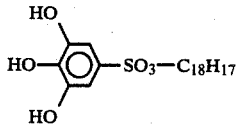 | 0.85 | 0.85 | 0.75 | 88 | 0.06 | 0.09 | 0.11 | 91 |
| Comparative Examples | | | | | | | | | |
| 1 | 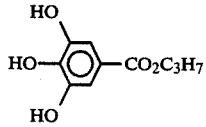 | 0.45 | 0.45 | 0.40 | 88 | 0.20 | 0.28 | 0.30 | 23 |
| 2 | 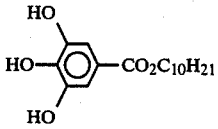 | 0.65 | 0.65 | 0.60 | 92 | 0.18 | 0.25 | 0.27 | 33 |
| 3 | 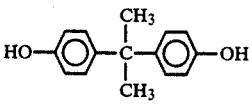 | 0.85 | 0.85 | 0.30 | 35 | 0.11 | 0.18 | 1.15 | 6 |
| 4 | 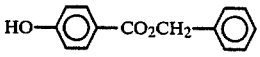 | 1.10 | 1.10 | 0.12 | 10 | 0.07 | 0.09 | 1.20 | 4 |

TABLE 1-continued

| Electron donor (Color developing agent) | Optical density (1) | Results of performance test: Oil resistance: Before oil treatment | After oil treatment (2) | Residual density (%) (3) | Background: Before oil treatment | Humidity-resistance (4) | Solvent-resistance (5) | Solvent-resistance (%) (6) |
|---|---|---|---|---|---|---|---|---|
| 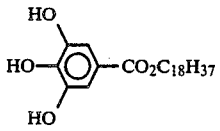 | 0.55 | 0.78 | 0.45 | 58 | 0.15 | 0.20 | 0.70 | 25 |

The effects of this invention are as follows.

(1) Clear image having high density is obtained in the printing with high density and high velocity owing to excellent thermal response.

(2) Developed image is stable against hairoils, oily substances, etc.

(3) There is no color-forming even after the contamination with a solvent such as alcohol, and the color-developing layer is not washed away by a solvent.

(4) The background is stable under high humidity.

We claim:

1. A heat-sensitive recording material comprising a support and having thereon a color-developing layer, wherein said color-developing layer comprises both a saturated higher fatty acid iron salt having 16–35 carbon atoms and a polyvalent phenolic derivative represented by the following general formula (I):

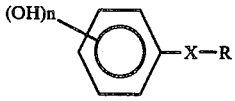

(I)

where R represents an alkyl group having 18–35 carbon atoms, n represents an integer from 2 to 3, and —X— represents —$CH_2$—, —O—, —CONH—,

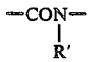

(R′ is an alkyl group having 5–10 carbon atoms), —$SO_2$—, —$SO_3$—, or —$SO_2NH$—.

2. The heat-sensitive recording material according to claim 1, wherein said saturated higher fatty acid iron salt is iron behenate.

3. The heat-sensitive recording material aocording to claim 1, wherein said polyvalent phenolic derivative is a compound represented by the following general formula (II):

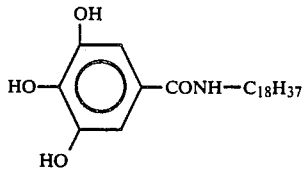

(II)

4. The heat-sensitive recording material according to claim 1, wherein said saturated higher fatty acid iron salt is iron stearate.

5. The heat-sensitive recording material according to claim 1, wherein said color-developing layer comprises 1–6 parts by weight of polyvalent phenolic derivative and 2–15 parts by weight of filler, based on 1–6 parts by weight of saturated-higher fatty acid iron salt, and 0.5–4 parts by weight of binder in total solid content.

6. The heat-sensitive recording material according to claim 1, wherein said color-developing layer lies on the support.

7. The heat-sensitive recording material according to claim 6, wherein said support is at least one member selected from a group consisting of paper, synthetic paper and film.

* * * * *